US007945991B2

(12) United States Patent
Hamm et al.

(10) Patent No.: US 7,945,991 B2
(45) Date of Patent: May 24, 2011

(54) VACUUM CLEANER COMPRISING AN OPERATING ROCKER

(75) Inventors: Silvio Hamm, Sülzfeld (DE); Roland Illig, Heustreu (DE); Jörg Schröter, Gröbenzell (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1005 days.

(21) Appl. No.: 10/587,668

(22) PCT Filed: Jan. 26, 2005

(86) PCT No.: PCT/EP2005/050324

§ 371 (c)(1),
(2), (4) Date: Jun. 22, 2007

(87) PCT Pub. No.: WO2005/072591

PCT Pub. Date: Aug. 11, 2005

(65) Prior Publication Data

US 2008/0034533 A1 Feb. 14, 2008

(30) Foreign Application Priority Data

Jan. 30, 2004 (DE) ..... 10 2004 004 859

(51) Int. Cl.
*A47L 9/28* (2006.01)
*H01H 25/00* (2006.01)

(52) U.S. Cl. ..... 15/339; 15/319; 200/18; 200/339

(58) Field of Classification Search ..... 15/319, 15/339; 200/18, 339; *A47L 9/28; H01H 25/00*
See application file for complete search history.

(56) References Cited

U.S. PATENT DOCUMENTS 4,139,923 A * 2/1979 Rother ..... 15/339

FOREIGN PATENT DOCUMENTS

| | | |
|---|---|---|
| DE | 44 13 884 | 10/1995 |
| DE | 196 07 148 | 8/1997 |
| DE | 199 47 980 | 4/2001 |
| EP | 1 297 775 | 4/2003 |

OTHER PUBLICATIONS

International Search Report PCT/EP2005/050324.

* cited by examiner

*Primary Examiner* — David A Redding
(74) *Attorney, Agent, or Firm* — James E. Howard; Andre Pallapies

(57) ABSTRACT

An actuating element mounted on an electrical appliance for pivotal movement about a pivoting axis in the switching direction of a switch, in order to switch a function of the electrical appliance by actuating the switch, and comprises a slide with an actuating surface that is guided along a slide path provided on the actuating element to adjust an operating parameter. An operating rocker/slide is provided enabling uniform forces introduced into the operating rocker during displacement of the slide. The actuating element includes the slide path and the pivoting axis extending substantially parallel to each other. The parallel orientation of the pivoting axis and the slide path enables the same length of lever arm to be obtained in relation to the pivoting axis of the actuating element, in each position of the slide, during the introduction of forces into the actuating surface of the slide.

20 Claims, 5 Drawing Sheets

VACUUM CLEANER COMPRISING AN OPERATING ROCKER

The invention relates to a vacuum cleaner.

In vacuum cleaners it is generally known to construct actuating elements used for switching a function of the electrical appliance as an operating rocker. Also known in vacuum cleaners are operating rockers which comprise an adjusting element such as a sliding potentiometer for adjusting the speed of the vacuum cleaner blower. With operating rockers of this type, the problem arises that when actuating the sliding potentiometer, such a force can be exerted on the operating rocker that a switch to be actuated by the operating rocker can also be unintentionally actuated.

Known from DE 196 07 148 C2 is an operating rocker on which a sliding potentiometer is provided. The operating rocker provided there has stop members which prevent unintentional switching of the operating rocker during actuation of the sliding potentiometer. According to the solution provided there, a counter-stop member projecting towards a stop member provided on the vacuum cleaner housing is provided on the inside of the operating rocker in the area of at least one of the actuating elements, wherein at least one of these members has such a profile in the abutting area on actuation of the operating rocker that when a force component acts substantially perpendicularly to the stop and counter-stop members, these members slide apart.

A disadvantage with this solution however is that the sliding potentiometer can only be arranged in a central area of the operating rocker to ensure the operating mode of the stop members. A further disadvantage of this arrangement of operating rocker and sliding potentiometer is that depending on the position of the actuating surface of the sliding potentiometer, a force of different magnitude can be applied to the operating rocker. For example, in a central position of the actuating surface of the sliding potentiometer, virtually no force is introduced into the operating rocker which could cause pivoting of the operating rocker. On the other hand, in both end positions of the actuating surface of the sliding potentiometer, the forces introduced into the operating rocker via the actuating surface of the sliding potentiometer are of approximately the magnitude required to switch operating rocker. This circumstance makes design tuning difficult for switching the operating rocker and adjusting the sliding potentiometer.

It is the object of the invention to eliminate the disadvantages indicated above. In particular, an operating rocker/slider combination should be provided wherein at least approximately uniform forces are introduced into the operating rocker during the displacement of the slider.

According to the invention, this object is achieved by the slide path and the pivoting axis extending at least substantially parallel to one another.

As a result of the at least substantially parallel alignment of the pivoting axis and the slide path, the same length of lever arm is predefined in relation to the pivoting axis of the actuating element in each position of the slide during the introduction of forces into the actuating surface of the slide. On the basis of such a constant lever arm, the regulation between the slider and the actuating element embodied as an operating rocker can be carried out particularly reliably. Preferred embodiments of such are given in the dependent claims.

The slide path and the pivoting axis are preferably arranged so that they run in a plane wherein a normal to the actuating surface of the slide is located. During the displacement of the slider by a user, forces are introduced into the actuating surface of the slider and these are transferred into the pivoting actuating element perpendicular to this actuating surface. As result of the perpendicular arrangement of the actuating surface of the slider in relation to the pivoting axis of the actuating element, the forces introduced via the actuating surfaces are introduced into the actuating element substantially directly along the pivoting axis. This has the consequence that the forces introduced into the actuating element via the actuating surface cause no pivoting movement of the actuating element. This is ensured by the forces that are introduced being introduced directly along the pivoting axis without any lever arm. At the same time, no torque is introduced in the actuating element which would cause pivoting of the actuating element. Even if in the ideal case, the forces introduced should run directly through the pivoting axis, it is already sufficient for this solution variant if the forces introduced via the actuating surface of the slide are introduced into the actuating element at least very close to the pivoting axis. Thus, a very small lever arm exists and very small torques are introduced in the actuating element. If the operating rocker and slide are suitably designed, these small torques are negligible however. Such small torques introduced into the actuating element can be compensated, for example, by means of a pre-tensioning spring according to the invention which is described subsequently.

In an advantageous embodiment of the invention, the slide path is arranged so that it runs above the pivoting axis. As a result of this arrangement, the actuating surface of the slide emerges from the contour of the actuating element in a particularly advantageous manner, making the use of the electrical appliance according to the invention particularly user-friendly. As a result of the arrangement of the slide path above the pivoting axis, this is structurally covered in such a manner that the structural means enabling the pivoting movement of the actuating element are substantially visually concealed.

The pivoting axis can preferably run through two bearing eyes which are constructed on the actuating element in opposing tabs between which the slide path runs and engage in the two pivot pins disposed on the electrical appliance. Such a design has the advantage that the actuating element can be mounted simply by snapping on the electrical appliance. At the same time, no further fixing means are required for pivotally mounting the actuating element on the electrical appliance. This measure particularly simplifies assembly and thus reduces the manufacturing costs for the electrical appliance. At the same time, it is not absolutely essential that the tabs provided with the bearing eyes are constructed on the actuating element and the pivot pins on the electrical appliance. The tabs provided with the bearing eyes can alternatively also be provided on the electrical appliance and the pivot pins can be provided on the actuating element. However, the variant where the tabs having the bearing eyes are provided on the actuating elements is preferable in order to provide a cost-effective tool for producing an actuating element according to the invention.

In an advantageous embodiment of the invention, the slide is mounted on a surface section of the actuating element which extends starting from the pivoting axis away from the switch in such a manner that a force introduced via the actuating surface of the slider is introduced into the actuating element in the direction opposite to the switching direction (FIG. 6). This specific solution does not aim to introduce the smallest possible force or no force into the actuating element via the actuating surface of the slide. Rather, in this specific solution significantly high forces should be introduced into the actuating element via the actuating surface of the slide if these bring about pivoting of the actuating element in the direction opposite to its switching direction. This will particularly be the case if the slide or the slide path is disposed opposite to the actuating surface for switching the operating rocker in relation to the pivoting axis.

In an alternative variant of the invention, the slide is mounted on a surface section of the actuating element which extends starting from the pivoting axis in the direction of the switch and the actuating surface of the slide is embodied in position and shape in such a manner that the force introduced into the actuating surface runs through the pivoting axis (FIGS. 2 to 4). This solution according to the invention takes account of the finding that the position in which the slide or the slide path actually runs along the actuating element is not necessarily important but that in particular, the position and shape of the actuating surface of the slide is crucial in determining in which direction forces are introduced into the actuating element via the slide. According to this advantageous variant, it is proposed to give the slide or the actuating surface of the slide a suitable shape where forces introduced via the actuating surface preferably run through the pivoting axis so that the forces introduced cannot trigger any pivoting movement of the actuating element in the switching direction. It is particularly advantageous if the shape of the slide or the actuating element is selected such that the introduced forces are introduced into the actuating element in such a manner that they cause pivoting of the actuating element in a direction opposite to the switching direction. This prevents the actuating element from being moved in the switching direction when actuating the slide to a particular extent.

A particularly favourable shape for the slide is achieved according to the invention if the actuating surface of the slide is embodied as flat and has an inclination with respect to the surface section of the actuating element at which a force introduced into the actuating surface acts in a direction which intersects the pivoting axis (FIG. 5). As a result of the flat embodiment of the actuating surface of the slide, the user is presented with a preferred actuating surface on the slider whereby it is largely ensured that the user actuates the slide at that point where the forces introduced into the slide are introduced particularly favourably into the actuating element. The inclination of the actuating surface with respect to the actuating element then predetermines the direction for the forces to be introduced. The inclination should be determined separately for each individual case depending on the design of the actuating element.

In an advantageous design of the actuating element according to the invention, the slide path is predefined by a slit-shaped opening in the actuating element through which the slide is guided along its slide path on the actuating element. In such an embodiment, the slide can be guided along the slide path on the actuating element and be mounted on the actuating element, i.e. slide and actuating element can be pre-assembled as a pre-assembled component. However, the slide can also merely be guided on the actuating element without the slide being mounted on the actuating element. In this alternative, the slide is not mounted on the actuating element but directly on the electrical appliance and the slide merely projects through the slit-shaped opening on the upper side of the actuating element.

In order to transfer its movement along the slide path onto a slide regulator disposed on the electrical appliance, the slide can be connected to an arm which acts on the slide regulator. The slide regulator can be a sliding potentiometer, for example which comprises an Ohmic resistance path on which an electrical pick-up is displaceably guided. This type of sliding potentiometer is relatively expensive so that rotary potentiometers, so-called trimmers, are usually preferred. In order to convert the sliding movement of the slide into a rotary movement of the rotary potentiometer, a spindle mounted rotatably on the electrical appliance can be provided, its axis acting on the rotary potentiometer and the slide acting on its helical contour. In such a solution it is advantageous if the slide is connected to an arm which acts on the slide regulator in order to transfer its movement along the slide path on a slide regulator disposed on the electrical appliance. In this case, the arm preferably has a projection which engages between two entraining elements connected to the slide regulator which transmit the movement of the slide along the slide path onto the slide regulator. Despite using an arm on the slide and a separate entraining element and a helical transducer, this solution is generally more cost-effective than a sliding potentiometer.

In a preferred embodiment, the arm projects through the slit-shaped opening and is supported on the electrical appliance to intercept forces acting in the direction of switching, introduced via the actuating surface. In this case, the slide is substantially not mounted on the actuating element itself but directly on the electrical appliance. This has the advantage that the slide is largely decoupled from the pivoting actuating element and thus forces can only be introduced into the pivoting actuating element to an insignificant extent when actuating the slide. The forces introduced are largely introduced directly through the support on the electrical appliance.

The entraining element preferably has a minimum size at which the projection of the arm is slidingly in engagement with the entraining elements in each pivoting position of the actuating element. On the one hand, this ensures that the operating parameters of the electrical appliance can be adjusted in each pivoting position of the actuating element of the slide. On the other hand, the slide arm is decoupled from the entraining elements of the potentiometer in such a manner than in a depressed, pivoted position of the actuating element, no materials stresses occur in the slide arm. The configuration just described particularly has the advantage that the operating parameters of the electrical appliance can be simultaneously adjusted by means of the slide even in the depressed position of the actuating element in the switching direction.

The entraining elements can be provided on a pivoted link which sits on a spindle mounted on the electrical appliance which converts the sliding movement of the pivoted link into a rotary movement to actuate a rotary potentiometer. As a result of this solution, an expensive sliding potentiometer can be replaced by a competitively priced rotary potentiometer.

The arm of the slide can have a spring-elastic locating lug supported on the inside of the actuating element which secures the arm of the slide inserted in the slit-shaped opening from outside the actuating element against pulling out this configuration particularly simplifies the mounting of the slide on the actuating element. The slides is reliably guided and mounted on the actuating element merely by inserting the arm provided on the slider into the slit-shaped opening of the actuating element. Once the slide has been mounted on the actuating element, it can no longer be lost. It is particularly advantageous that no separate fixing or bearing means are required to mount the slide on the actuating element. This has the result that an electrical appliance provided with the actuating element according to the invention can be produced cost-effectively.

In each embodiment of the invention, a pre-tensioning element can be provided, which pre-tensions the actuating element in the direction opposite to the switching direction with a force larger than that required to displace the slide, which is introduced into the actuating element in the switching direction. The pre-tensioning element provides additional security such that even when very large forces are introduced into the actuating surface of the slide, these are additionally intercepted so that only small forces are introduced into the actuating element which could cause pivoting of the actuating element.

The actuating element according to the invention can preferably be used in electrical household appliances and in particular in vacuum cleaners. In vacuum cleaners it is firstly necessary to switch the vacuum cleaner on or off by means of a switch and adjust a desired power during operation of the vacuum cleaner. Such an adjustment of an operating parameter and switching a function is triggered by the actuating element according to the invention in a particularly pleasant and advantageous manner for the user.

A preferred exemplary embodiment of an actuating element according to the invention is explained in detail hereinafter with reference to FIGS. 1 to 6.

Figure 1:
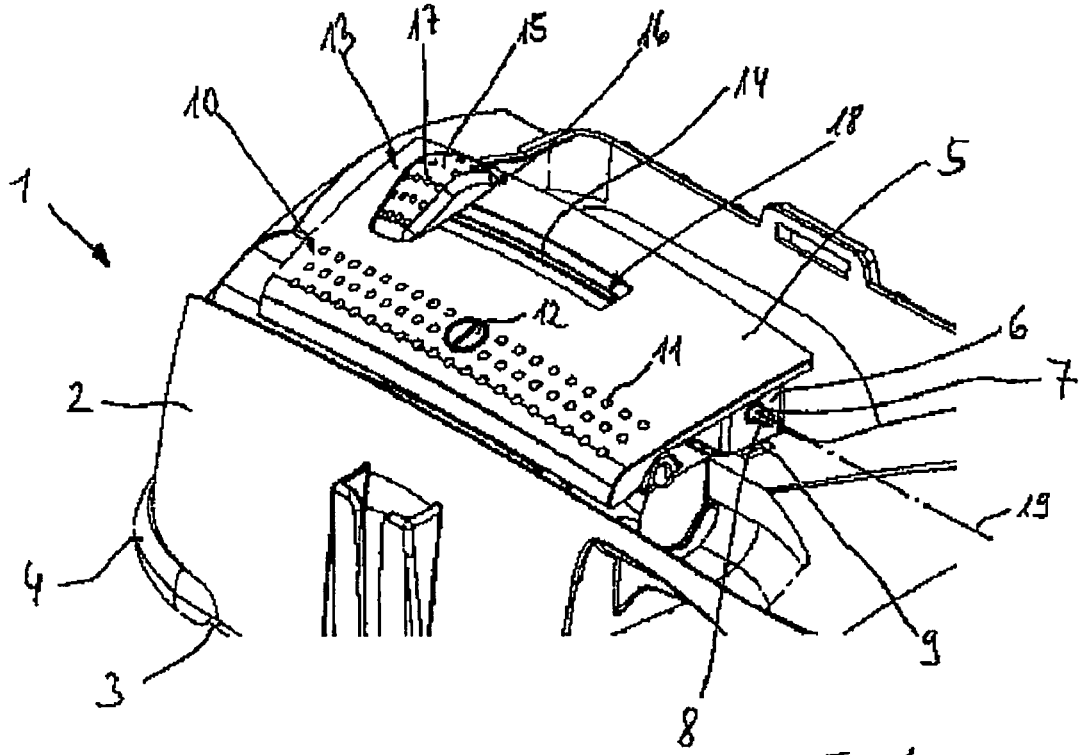
FIG. 1 is a perspective view of a rear area of a vacuum cleaner provided with an actuating element according to the invention.

A vacuum cleaner 1 shown in a perspective sectional view in FIG. 1 comprises a housing casing 2 in the rear area of the vacuum cleaner 1. The housing casing 2 sits on a lower shell 3 of the vacuum cleaner 1 and encloses electrical components of the vacuum cleaner 1 which are not shown, such as a fan unit, for example, a cable drum or electronic control elements. An impact protection strip 4 is inserted between the housing casing 2 and the lower shell 3. An actuating element 5 is pivotally mounted on the upper side of the housing casing 2. The actuating element 5 has two oppositely located tabs 6 for the pivotal mounting. Each tab 6 has respectively one bearing eye 7. The bearing eye 7 is embodied as a circular opening in the tab 6. The tabs 6 are constructed in one part with the actuating element 5 and are produced by plastic injection moulding. A pivot pin 8 projects into the opening of each bearing eye 7. The pivot pins 8 are connected to the housing cap 2 by means of a bearing block 9. Like the tabs 6, the pivot pins 8 are also constructed in one part with the housing cap 2 and are produced by plastic injection moulding. The connection of the bearing eyes 7 and pivot pins 8 forms a hinge arrangement which allows the actuating element 5 embodied as an operating rocker to pivot.

A front surface section 10 of the actuating element 5 bears a plurality of hemispherical knobs 11 which not only indicates to the user the surface over which he can pivot the actuating element 5 by pressing in the switching direction but also prevents slippage during actuation of this operating rocker. For optical recognition of the function which can be triggered by pivoting the operating-rocker-like actuating element 5, on its upper side in a central area of the surface section 10 provided with hemispherical knobs 11 the actuating element 5 has a pictogram-like elevation 12.

The actuating element 5 is provided with a slit-shaped opening 14 on a rear surface section 13. An actuating surface 15 of a slide 16 projects from the slit-shaped opening 14. Further hemispherical knobs 17 are attached to the actuating surface 15 of the slide 16. The slit-shaped opening 14 predefines a slide path 18 which extends parallel to a pivoting axis 19 of the actuating element 5.

Figure 2:
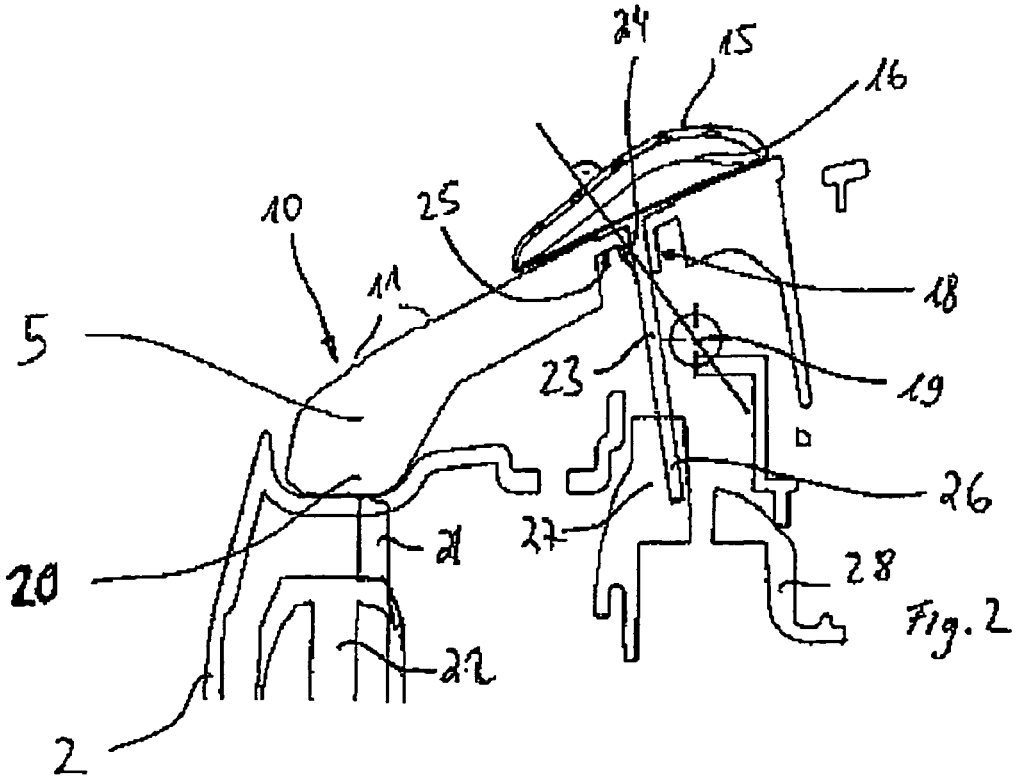
FIG. 2 is a sectional view through the actuating element according to FIG. 1 in its position depressed in the switching direction.

FIG. 2 shows a sectional view of the actuating element 5 in its position depressed in the switching direction. The front surface section 10 bearing knobs 11 lies above a switching cam 20 moulded on the actuating element 5 which presses onto a cam follower 21 of an electrical switch 22 in the switching direction. The switch 22 is held in the housing casing 2. The actuating elements 5 is pivotally mounted about the pivoting axis 19 on the housing casing 2. In the position shown in FIG. 2 the slide path 18 running parallel to the pivoting axis 19 thus runs out from the plane of the drawing. The slide 16 bearing the actuating surface 15 is provided with an arm 23 on its lower side, this arm being moulded onto the slide 16 in one piece. The slide 16 is guided along the slide path on the actuating element 5 by means of the arm 23 which projects through the slit-shaped opening 14. The arm 23 has a spring-elastic locating lug 24 which is supported on the inner side 25 of the actuating element 5 in the built-in position of the slide 16. The arm 23 bears a projection 26 at its lower end which engages in two successively located entraining elements 27 in FIG. 2. The entraining elements 27 located at a distance from one another are moulded on a pivoted link 28.

Figure 3:
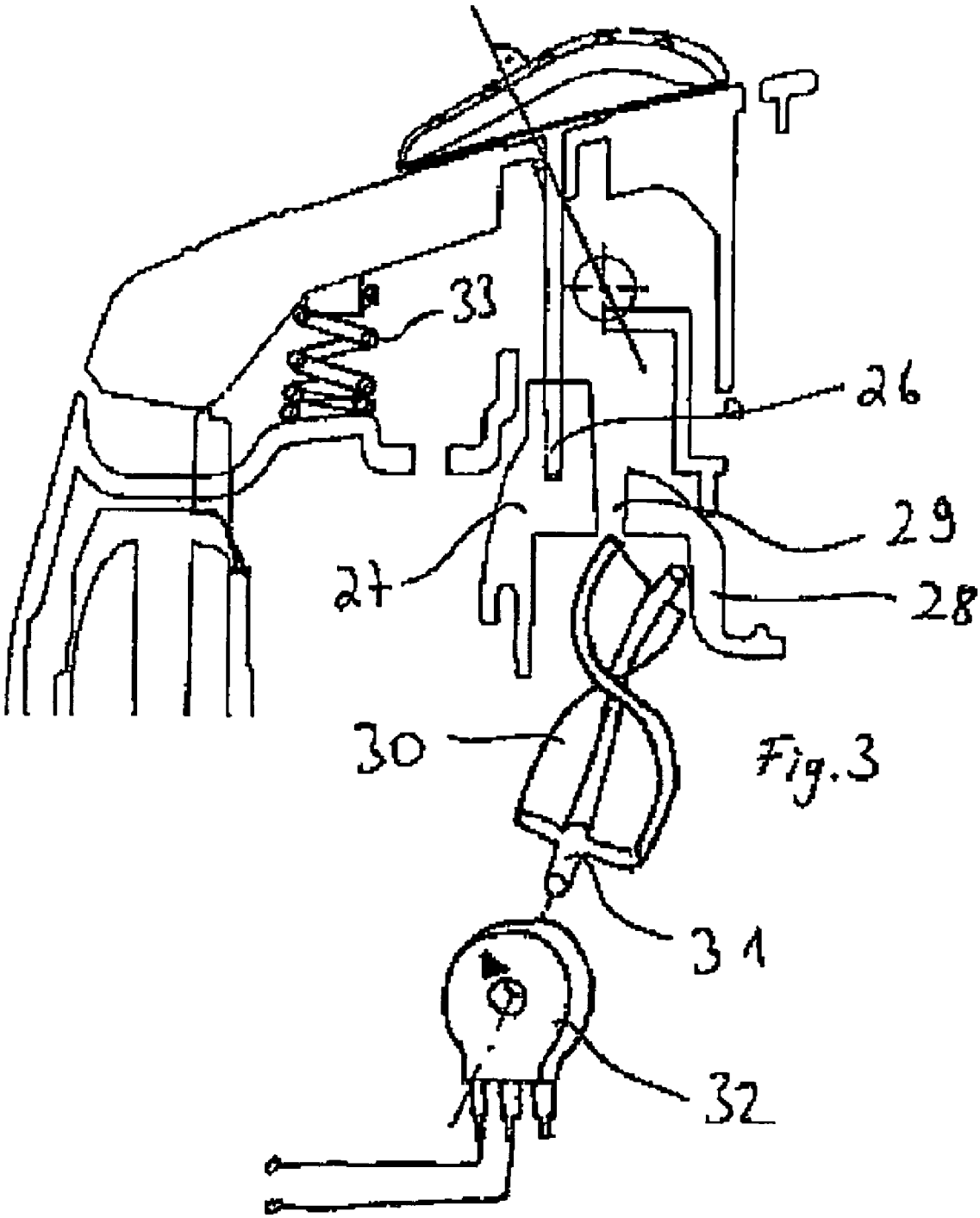
FIG. 3 is a sectional view through the actuating element according to FIG. 2 in its initial position.

As shown in FIG. 3, the pivoted link 28 has an engaging slit 29 in which a spindle 30 engages. An axial pin 31 is moulded on the spindle 30, this pin being inserted in a rotary potentiometer 32 in its built-in position. By displacing the slide 16, the arm 23 is displaced together with its projection 26 along the slide path 18. At the same time, the pivoted link 28 is displaced by the projection 26 engaging in the entraining members 27 of the pivoted link 28. As a result of the sliding of the pivoted link 28, the spindle 30 engaging in the engaging slit 29 is set in rotation. The rotation of the spindle 30 is transmitted by means of the axial pin 31 to the rotary potentiometer 32 which is connected electrically to a control circuit, not shown, to regulate a blower unit of the vacuum cleaner 1. FIG. 3 also shows a pre-tensioning element 33 embodied as a helical spring which pre-tensions the actuating element in the direction opposite to its switching direction in the initial position.

Figure 4:
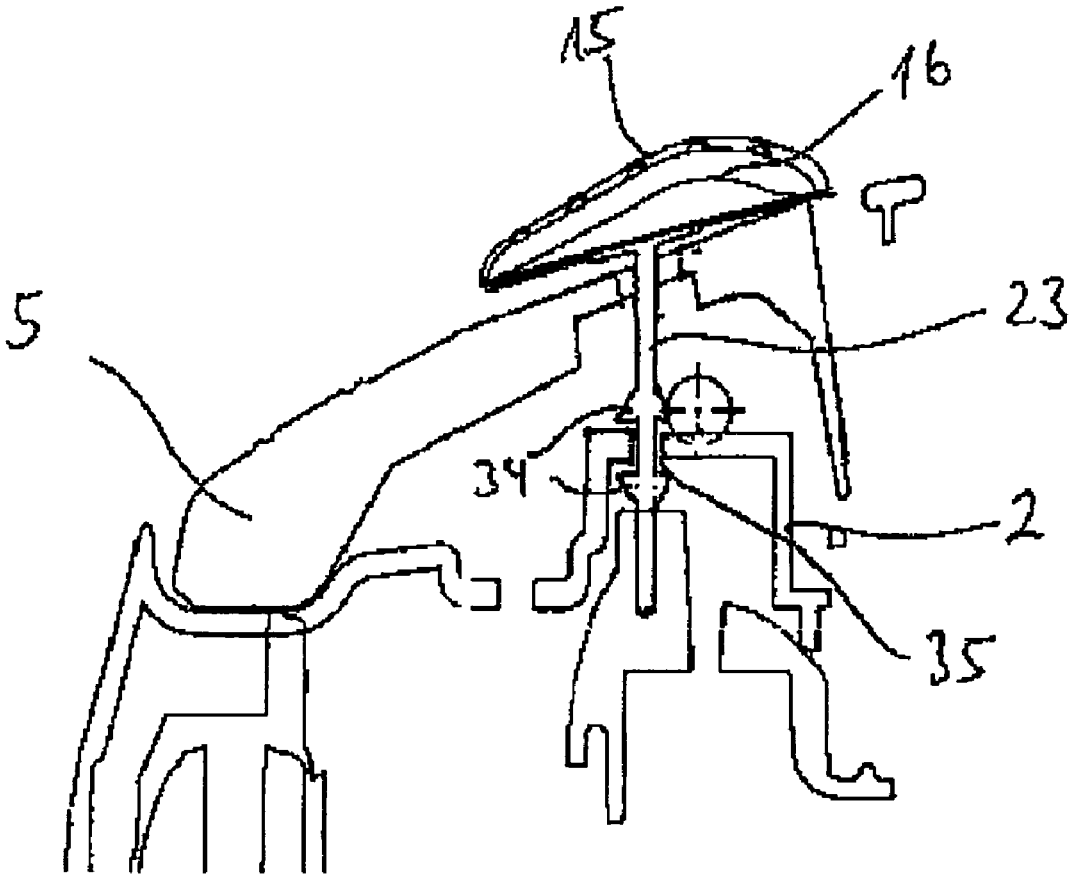
FIG. 4 is a sectional view through the actuating element supported on a housing of the vacuum cleaner in its position depressed in the switching direction.

FIG. 4 shows a variant of an actuating element 5 according to the invention in which the slide 16 is not mounted on the actuating element 5 but on the housing cap 2. For this purpose the arm 23 moulded on the slide 16 has supporting ribs 34 by which means the arm 23 and therefore also the slide 16 is supported on the housing casing 2. For displaceable mounting of the slide 16 the housing cap 2 has a slit-shaped slide path in which the arm 23 is displaceably guided and retained. If compressive forces are introduced via the actuating surface 15 of the slide 16, these are introduced directly into the housing cap 2 and do not enter into the pivoting actuating element 5. For reliable decoupling of the slide 16 and actuating element 5, the slit-shaped opening 14 is dimensioned such that there is no direct contact between the arm 23 of the slide 16 and the actuating element 5 in the position of the actuating element 5 actuated in the switching direction (as shown in FIG. 4).

Figure 5:
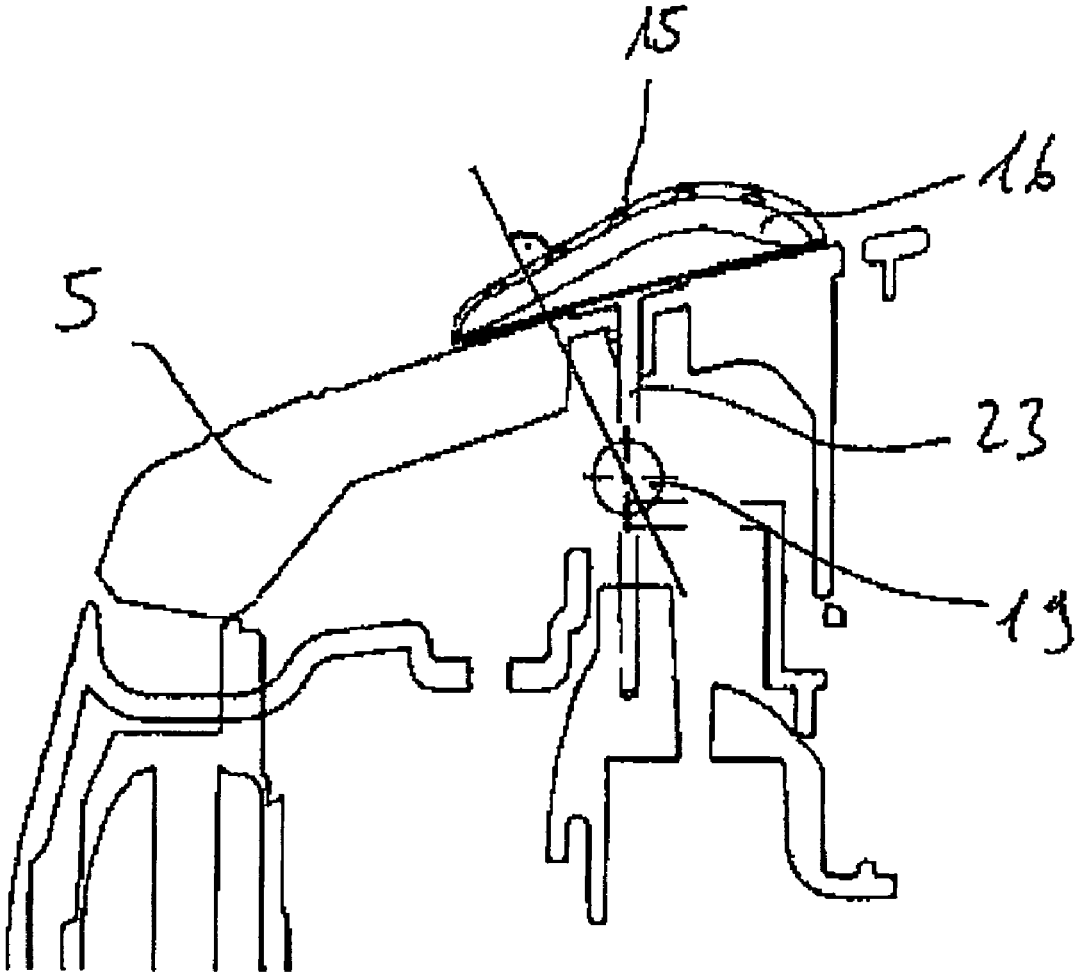
FIG. 5 is a sectional view through an actuating element where the slide is arranged so that it runs above the pivoting axis.

In another alternative variant, as shown in FIG. 5, both the normal to the actuating surface 15 and also the arm 23 of the slide 16 run through the pivoting axis 19 of the actuating element 5. In this variant, despite the slide 16 being mounted directly on the actuating element 15, no forces which could trigger an unintentional pivoting movement of the actuating element 5 in the switching direction are produced since no lever arm is produced for the introduced forces which could introduce a torque in the switching direction.

Figure 6:
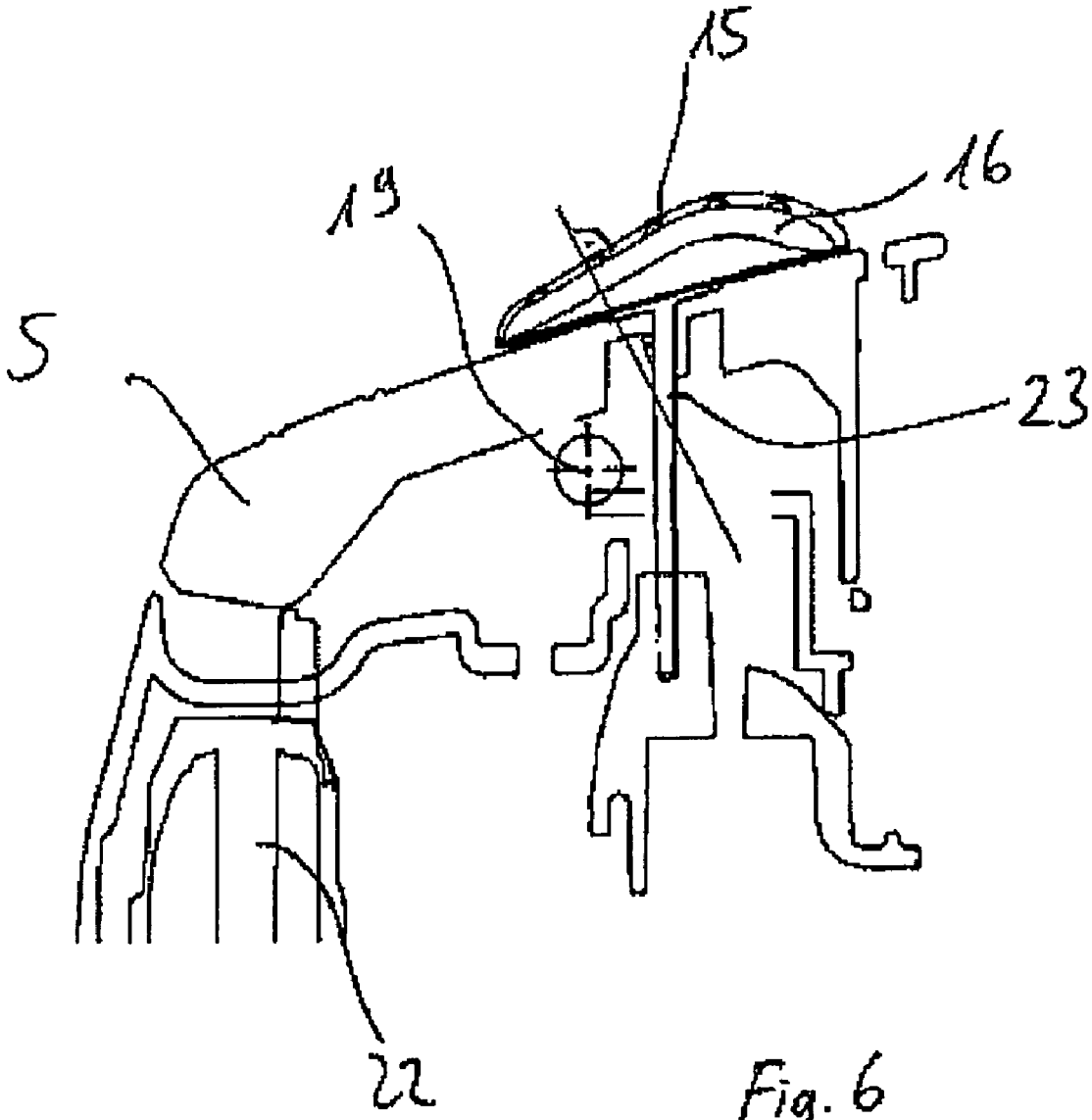
FIG. 6 is a sectional view through the actuating element where the slide is mounted on a surface section which extends from the pivoting axis away from a switch.

In an additional alternative variant as shown in FIG. 6, the slide is mounted on a surface section which extends from the pivoting axis away from the switch 22. In this case, both the normals to the actuating surface 15 and also the arm 23 are located behind the pivoting axis 19, that is on the side of the pivoting axis 19 opposite to the switch 22. In this variant, during actuation of the slide 16 forces are always introduced into the actuating element 5 which trigger a pivoting of the actuating element 5 into the initial position in the direction opposite to the switching direction. In this case, it is not possible to switch the switch 22 by pivoting the actuating element 5 during displacement of the slide 16.

The invention claimed is:

1. An actuating element mounted on an electrical appliance in such a way that it can pivot about a pivoting axis in the switching direction of a switch in order to switch a function of an electrical appliance by actuating a switch and comprises a slide provided with an actuating surface which is displaceably guided along a slide path provided on the actuating element in order to adjust an operating parameter, the slide path and the pivoting axis extending substantially parallel to one another.

2. The actuating element according to claim 1, wherein the slide path and the pivoting axis are arranged so that they run in a plane wherein a normal to the actuating surface of the slide is located.

3. The actuating element according to claim 1, wherein the slide path is arranged so that it runs above the pivoting axis.

4. The actuating element according to claim 1, wherein the pivoting axis runs through two bearing eyes which are constructed on the actuating element in opposing tabs between which the slide path runs and engage in the two pivot pins disposed on the electrical appliance.

5. The actuating element according to claim 1, wherein the slide is mounted on a surface section of the actuating element which extends starting from the pivoting axis away from the switch in such a manner that a force introduced via the actuating surface of the slider is introduced into the actuating element in the direction opposite to the switching direction.

6. The actuating element according to claim 1, wherein the slide is mounted on a surface section of the actuating element which extends starting from the pivoting axis in the direction of the switch and the actuating surface of the slide is embodied in position and shape in such a manner that the force introduced into the actuating surface runs through the pivoting axis.

7. The actuating element according to claim 6, wherein the actuating surface of the slide is embodied as flat and has an inclination with respect to the surface section of the actuating element at which a force introduced into the actuating surface acts in a direction which intersects the pivoting axis.

8. The actuating element according to claim 1, wherein the slide path is predefined by a slit-shaped opening in the actuating element through which the slide is guided along its slide path on the actuating element.

9. The actuating element according to claim 8, wherein in order to transfer its movement along the slide path onto a slide regulator disposed on the electrical appliance, the slide is connected to an arm which acts on the slide regulator.

10. The actuating element according to claim 9, wherein the arm projects through the slit-shaped opening and is supported on the electrical appliance to intercept forces acting in the direction of switching, introduced via the actuating surface of the slide.

11. The actuating element according to claim 9, wherein the arm has a projection which engages between two entraining elements connected to the slide regulator which transmit the movement of the slide along the slide path onto the slide regulator.

12. The actuating element according to claim 11, wherein the entraining elements have a minimum size at which the projection of the arm slidingly engages the entraining elements in each pivoting position of the sliding element.

13. The actuating element according to claim 11, wherein the entraining elements are provided on a pivoted link which sits on a spindle mounted on the electrical appliance which converts the sliding movement of the pivoted link into a rotary movement to actuate a rotary potentiometer.

14. The actuating element according to claim 9, wherein the arm has a spring-elastic locating lug supported on the inside of the actuating element which secures the arm of the slide inserted in the slit-shaped opening from outside the actuating element against pulling out.

15. The actuating element according to claim 1, further comprising a pre-tensioning element pre-tensioning the actuating element in the direction opposite to the switching direction with a force larger than that required to displace the slide, which is introduced into the actuating element in the switching direction.

16. A vacuum cleaner comprising:

a housing;

an actuating element mounted on the housing for pivotal movement with respect to the housing about a pivot axis;

a slit-shaped opening extending along an outer surface of the actuating element;

a switch disposed within the housing and being actuated in response to movement of the actuating element to control a function of the vacuum cleaner; and a slide mounted for translational movement with respect to the housing along a slide path to adjust an operating parameter of the vacuum cleaner, the slide being disposed adjacent the outer surface of the actuating element and having an arm extending through the slit-shaped opening.

17. The vacuum cleaner according to claim 16, wherein the slide path and the pivoting axis extending substantially parallel to one another.

18. The vacuum cleaner according to claim 16, wherein the actuating element includes a front surface section and a rear surface section wherein the slide is disposed adjacent the rear surface section, the pivot axis being disposed between the arm and the front surface.

19. The vacuum cleaner according to claim 16, wherein the slide is slidably supported by the housing, the actuating element being free to pivot with respect to the slide.

20. The vacuum cleaner according to claim 16, further comprising:

an entraining element connected to an end of the arm within the housing and at least partially forming an engaging slit;

a spindle mounted for rotation about an axial pin and having spiral-shaped flanges extending outwardly from the axial pin, the entraining element engaging the flanges at least partially within the engaging slit and the spindle rotating about the axial pin in response to translational movement of the slide; and a rotary potentiometer coupled to the spindle and receiving rotary input from the axial pin.

* * * * *